United States Patent [19]

Bills

[11] 4,138,150

[45] Feb. 6, 1979

[54] WINDOW LOCK

[76] Inventor: Marius W. Bills, 16220 Schoolcraft, Detroit, Mich. 48227

[21] Appl. No.: 774,459

[22] Filed: Mar. 4, 1977

Related U.S. Application Data

[63] Continuation of Ser. No. 618,622, Oct. 1, 1975, abandoned.

[51] Int. Cl.[2] ..... E05B 69/00

[52] U.S. Cl. ..... 292/60; 292/DIG. 20; 292/DIG. 47

[58] Field of Search ..... 292/57, 58, 59, 60, 292/61, DIG. 20, DIG. 46, DIG. 47

[56] References Cited

U.S. PATENT DOCUMENTS

| | | | |
|---|---|---|---|
| 72,807 | 12/1867 | Cooper | 292/60 |
| 1,154,074 | 9/1915 | Strong | 292/332 |

FOREIGN PATENT DOCUMENTS

| | | | |
|---|---|---|---|
| 207739 | 12/1923 | United Kingdom | 292/60 |

*Primary Examiner*—Robert L. Wolfe
*Attorney, Agent, or Firm*—Barnes, Kisselle, Raisch & Choate

[57] ABSTRACT

A window comprising a first sash, and a second sash movable relative to one another, and a window lock mounted on one of the sashes. The window lock includes a housing having an inner wall adjacent one sash and an outer wall. A block is fixed on the inner surface of the outer wall. A plunger is slidable in openings in the inner and outer walls and block. The opening in the inner and outer walls are circular. The opening in the block includes radial portions and the plunger has a radial projection conforming generally to the radial projection of the opening in the block. The other sash has an opening adapted to be engaged by the plunger such that when the plunger is in engagement with the opening in the other sash the other end of said plunger is spaced from the outer surface of the other wall. A knob is releasably engageable with the outer end of the plunger for engaging the plunger and moving it axially to unlock the sashes. A spring yieldingly urges the plunger toward the opening in the other sash. A portion of the block adjacent the inner surface of the outer wall is cut away to provide a space so that when the radial projections are moved into the space, the plunger can be rotated to hold the plunger out of engagement with the opening in the other sash.

11 Claims, 5 Drawing Figures

FIG. 1
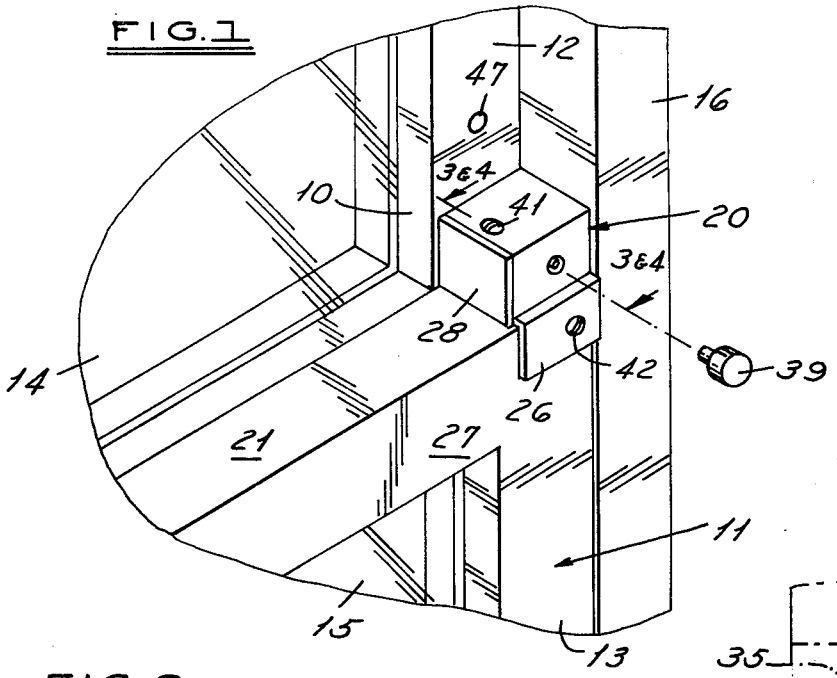
FIG. 2
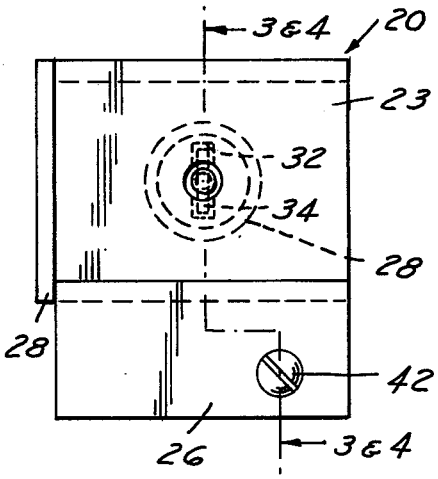
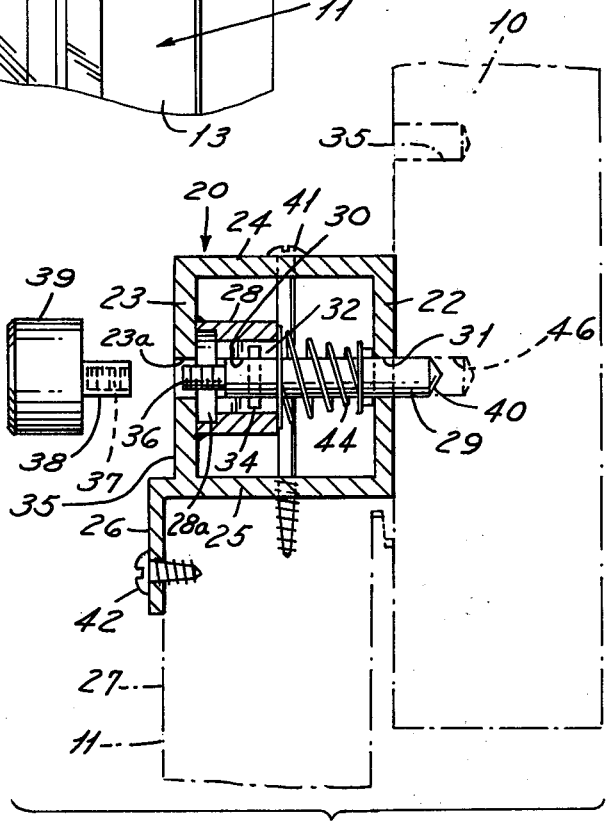
FIG. 3
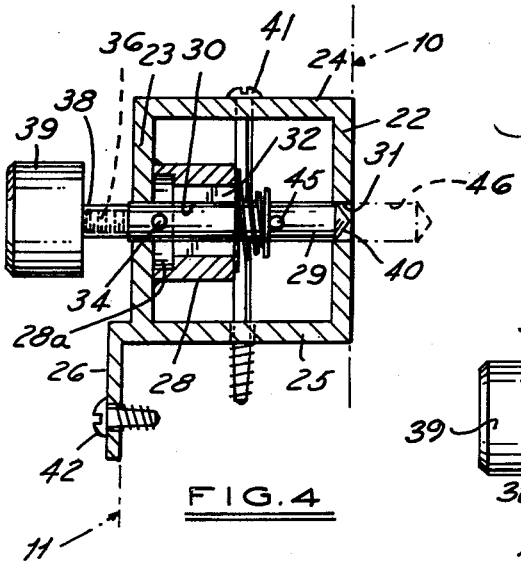
FIG. 4
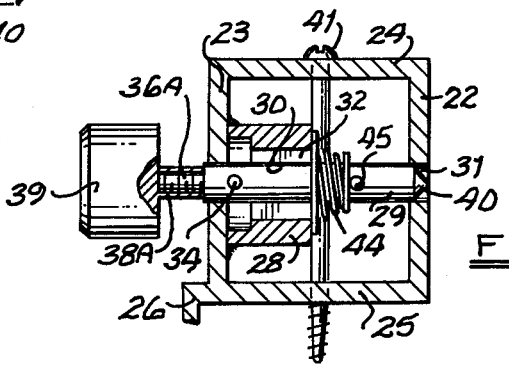
FIG. 5

WINDOW LOCK

This is a continuatin of application Ser. No. 618,622, filed Oct. 1, 1975 and now abandoned.

This invention relates to window locks.

BACKGROUND OF THE INVENTION

In windows which includes relatively movable sashes, it has been found that the conventional rotatable cam locks do not afford sufficient protection against intrusion. Accordingly, it has heretofore been suggested that various locks can be provided to lock the sashes in position.

Among the objects of the invention are to provide a window lock which will effectively lock the sashes relative to one another; which is relatively simple, low in cost and easily assembled; which can be easily installed; and which cannot be readily tampered with.

SUMMARY OF THE INVENTION

In accordance with the invention, the window lock includes a housing having an inner wall adjacent one sash and an outer wall. A block is fixed on the inner surface of the outer wall. A plunger is slidable in openings in the inner and outer walls. The openings in the inner and outer walls are circular. The opening in the block including radial portions and the plunger has a radial projection conforming generally to the radial projection of the opening in the block. The outer sash has an opening adapted to be engaged by the plunger such that when the plunger is in engagement with the opening in the other sash the other end of said plunger is spaced from the outer surface of the outer wall. A knob is releasably engageable with the outer end of the plunger for engaging the plunger and moving it axially to unlock the sashes. A spring yieldingly urges the plunger toward the opening in the other sash. A portion of the outer wall is cut away to provide a space so that when the radial projections are moved into the space, the plunger can be rotated to hold the plunger out of engagement with the opening in the other sash.

DESCRIPTION OF THE DRAWINGS

FIG. 1 is a fragmentary perspective view of a window embodying the invention;

FIG. 2 is a front elevational view of the lock;

FIG. 3 is a fragmentary sectional view taken along the line 3—3 in FIG. 2;

FIG. 4 is a sectional view taken along the line 4—4 in FIG. 2 showing the parts in a different operative position.

FIG. 5 is a fragmentary sectional view similar to FIG. 3 of a modified form of the invention.

DESCRIPTION

Referring to FIG. 1, the invention relates to conventional windows such as are found in homes which includes an upper sash 10 and a lower sash 11, each of which is formed with a frame 12, 13 and a window 14, 15 therein slidable along a track defined by a frame 16.

In accordance with the invention, the lock 20 embodying the invention is mounted on the top surface 21 of the frame 13 of sash 11 and comprises a housing that includes an inner wall 22, an outer wall 23, a top wall 24 and a bottom wall 25. The housing is made of an aluminum extrusion including an integral flange 26 that is adapted to engage the outer surface 27 of the frame of the lower sash 11.

As shown in FIG. 3, block or bushing 28 is fixed on the inner surface of the outer wall 23 and terminates in spaced relationship to the inner surface of the inner wall 22. A shaft or plunger 29 extends through an opening **23*a* in the outer wall 23 and block 28 and an opening 31 in the inner wall 22, the configuration of the openings 23*a*, 31 substantially corresponding to the cross section of the shaft 29**.

The major portion of block 28 further includes laterally extending portions 32 in the opening 30 that define a key slot intermediate the ends of the block 28. The plunger 29 includes a cross pin 34 corresponding generally in configuration to the portions 32 of the opening 30. A portion of the block 28 is cut away as at **28*a* to provide a space. A spring 44 is interposed between block 28 and a pin 45 on plunger 29. The plunger 29 is adapted to engage one or more openings 46, 47** in the upper sash depending upon whether the window is to be locked in full closed or partially opened position.

The lock is mounted in position by one-way screws 41 extending into the top surface 21 and by one-way screws 42 extending into the outer surface of the frame 27.

When the plunger 29 is moved axially inwardly the outer end of the plunger 29 is spaced from the outer surface 35 of outer wall 23 as shown in FIGS. 3 and 4. The outer end of the plunger 29 is preferably of reduced diameter and is formed with an external thread 36 which is adapted to be engaged by the internal thread 37 on a portion 38 fixed to a knob 39, the portion 38 having substantially the same outer diameter as the plunger 29.

When it is desired to unlock the window, the knob 39 is engaged with the plunger 29 by threading it on the outer end of the plunger. During the threading, the engagement of the pin 34 with the sides of the portions 32 of the opening prevents rotation. When the knob has been engaged with the plunger 29, the plunger can be retracted bringing the plunger out of engagement with the opening 46 in the upper sash. The pin 34 is retracted to space **28*a* so that rotation of plunger 29 will cause pin 34 to engage the block 28 and thereby hold the plunger out of engagement with the opening 34. When it is desired to again lock the windows, the plunger 29 is moved inwardly by turning the knob. The knob is then removed by unthreading from the end of the shaft or plunger, thereby leaving the end of the plunger in recessed relationship to the outer surface 35 so that it is not accessible. The free end 29 of the plunger is tapered as at 40 to deflect drills and the like that might be used in an effort to force the plunger 29** axially outwardly.

Further, it is preferred that out of a group of locks, the threads 36, 37 are changed so that at least some locks have different threads than others (FIG. 5). This would preclude a single knob 39 from being used to open a plurality of windows, thereby discouraging thieves and burglers. It is further contemplated that the threads would be of unconventional design such as blank in order to discourage the use of a conventional, readily available threaded part to withdraw the plunger.

I claim:

1. In a window, the combination comprising a first sash, a second sash, a frame along which said sashes are moved relative to one another, and a window lock mounted on one of said sashes, said window lock including a housing having an inner wall adjacent one sash and an outer wall, a plunger, said inner and outer walls having openings therethrough through which the plunger may extend, means for providing an opening within said housing aligned with the opening in the outer wall and having a portion with a radial portion, said opening of said last-mentioned means having another portion of larger cross section whereby said radial portion of said plunger is rotatably unrestrained when said radial projection is positioned at said portion, said plunger having a radial projection conforming generally to the radial portion of said opening defined by said last-mentioned means when said radial projection is positioned therein, said other sash having an opening adapted to be engaged by said plunger such that when the plunger is in engagement with said opening in said other sash the other end of said plunger extends into the opening in the outer wall and is spaced inwardly relative to the outer surface of the outer wall, a spring yieldingly urging said plunger in a direction toward said other sash, and means releasably engageable with the outer end of the plunger for engaging the plunger and moving it axially to unlock the sashes.

2. The combination set forth in claim 1 wherein said outer end of said plunger is threaded, said means releasably engageable therewith being a threaded knob.

3. The combination set forth in claim 2 including a plurality of locks, the interengaging means between the knobs and the plungers on at least some of said locks differing from that of others of said locks so that the knobs are not universally interchangeable.

4. In a lock for a window, the combination comprising a housing having an inner wall and an outer wall, a plunger, said inner and outer walls having openings therethrough through which the plunger may extend, means for providing an opening within said housing aligned with the opening in the outer wall and having a portion with a radial portion, said opening of said last-mentioned means having another portion of larger cross section whereby said radial portion of said plunger is rotatably unrestrained when said radial projection is positioned at said portion, said plunger having a radial projection conforming generally to the radial portion of said opening defined by said last-mentioned means when said radial projection is positioned therein, said other sash having an opening adapted to be engaged by said plunger such that when the plunger is in engagement with said opening in said other sash the other end of said plunger extends into the opening in the outer wall and is spaced inwardly relative to the outer surface of the outer wall, a spring yieldingly urging said plunger in a direction toward said other sash, and means releasably engageable with the outer end of the plunger for engaging the plunger and moving it axially to unlock the sashes.

5. The combination set forth in claim 4 wherein said outer end of said plunger is threaded, said means releasably engageable therewith being a threaded knob.

6. The combination set forth in claim 5 including a plurality of locks, the interengaging means between the knobs and the plungers on at least some of said locks differing from that of others of said locks so that the knobs are not universally interchangeable.

7. In a lock for a window, the combination comprising a housing comprising an extrusion defining an inner wall adjacent one sash and an outer wall, a plunger, said inner and outer walls having openings therethrough through which the plunger may extend, a block on the inner surface of said outer wall providing an opening within said housing aligned with the opening in the outer wall and having a portion with a radial portion, said opening of said last-mentioned means drawing another portion of larger cross section whereby said radial portion of said plunger is rotatably unrestrained when said radial projection is positioned at said portion, said plunger having a radial projection conforming generally to the radial portion of said opening defined by said last-mentioned means when said radial projection is positioned therein, said other sash having an opening adapted to be engaged by said plunger such that when the plunger is in engagement with said opening in said other sash the other end of said plunger extends into the opening in the outer wall and is spaced inwardly relative to the outer surface of the outer wall, a spring yieldingly urging said plunger in a direction toward said other sash, and means releasably engageable with the outer end of the plunger for engaging the plunger and moving it axially to unlock the sashes.

8. The combination set forth in claim 7 wherein said outer end of said plunger is threaded, said means releasably engageable therewith being a threaded knob.

9. The combination set forth in claim 8 including a plurality of locks, the interengaging means between the knobs and the plungers on at least some of said locks differing from that of others of said locks so that the knobs are not universally interchangeable.

10. In a window, the combination comprising a first sash, a second sash, a frame along which said sashes are moved relative to one another, and a window lock mounted on one of said sashes, said window lock including a housing having an inner wall adjacent one sash and an outer wall, a plunger, said inner and outer walls having openings therethrough through which the plunger may extend, a block on said outer wall having an opening within said housing aligned with the opening in the outer wall and spaced axially from the outer wall, said plunger having a radial projection, said opening within said housing having a radial portion into which said radial projection may extend, means defining a space of larger cross section than the opening within the housing and the opening in the outer wall such that the radial projection extends into said space when said projection is axially aligned with said space to restrain the plunger against axial movement, said other sash having an opening adapted to be engaged by said plunger such that when the plunger is in engagement with said opening in said other sash the other end of said plunger is spaced from the outer surface of the outer wall, said outer end of the plunger being threaded, said threaded end being positioned within the confines of the opening in the outer wall when the plunger engages the opening in the sash, said opening in said outer wall having a lesser cross section than the space between the outer wall and the means defining the opening within the housing, and a knob having a portion of reduced cross section corresponding to the cross section of the opening in the outer wall and removably threaded on the threaded end of said plunger.

11. In a lock for a window, the combination comprising a housing having an inner wall and an outer wall, a plunger, said inner and outer walls having openings therethrough through which the plunger may extend, means for providing an opening within said housing aligned with the opening in the outer wall and spaced axially from the outer wall, said plunger having a radial projection, said opening within said housing having a radial portion into which said radial projection may extend, means defining a space of larger cross section than the opening within the housing and the opening in the outer wall such that the radial projection extends into said space when said projection is axially aligned with said space to restrain the plunger against axial movement, said plunger being adapted to be moved axially into engagement with an opening in a sash or the like, said outer end of the plunger being threaded, said threaded end being positioned within the confines of the opening in the outer wall when the plunger engages the opening in the sash, said opening in said outer wall having a lesser cross section than the space between the outer wall and the means defining the opening within the housing, and a knob having a portion of reduced cross section corresponding to the cross section of the opening in the outer wall and removably threaded on the threaded end of said plunger.

* * * * *